United States Patent [19]

Buckley et al.

[11] 4,178,790

[45] Dec. 18, 1979

[54] ROLL-THROUGH COLD FORMING APPARATUS

[75] Inventors: James E. Buckley, Sterling Heights; Mitchell E. Bartold, St. Clair Shores; Marshall S. Heist, Sterling Heights; James L. Jessup, Livonia, all of Mich.

[73] Assignee: Ex-Cell-O Corporation, Troy, Mich.

[21] Appl. No.: 908,033

[22] Filed: May 22, 1978

[51] Int. Cl.[2] ..... B21D 51/12

[52] U.S. Cl. ..... 72/224; 72/402

[58] Field of Search ..... 72/224, 180, 468, 100, 72/110, 178, 194, 385, 474, 402, 189

[56] References Cited

U.S. PATENT DOCUMENTS

| | | | |
|---|---|---|---|
| 839,569 | 12/1906 | Numan | 72/224 X |
| 2,367,226 | 1/1945 | Lonsdale | 72/224 X |
| 2,430,368 | 11/1947 | Rearden | 72/224 X |
| 2,929,282 | 3/1960 | Retterath | 72/224 |
| 3,396,570 | 8/1968 | McCardell | 72/402 X |
| 3,763,688 | 10/1973 | Cug | 72/224 |
| 4,004,442 | 1/1977 | Strelchenko | 72/224 |

*Primary Examiner*—Milton S. Mehr

*Attorney, Agent, or Firm*—James H. Bower; Mitchell J. Hill

[57] ABSTRACT

A roll-through cold forming apparatus adapted to form simultaneously a plurality of either external or internal straight spline or gear type teeth on a cylindrical workpiece carried on a movable ram. In one embodiment the apparatus includes a plurality of radially disposed pivotally mounted teeth forming blades which are disposed around the axis of movement of a linearly movable ram, whereby when the ram moves in one direction past the teeth forming blades, the blades are engaged by an interference contact with the workpiece carried on the ram, and the teeth forming blades are moved over the external surface of the workpiece in a rolling contact action so as to displace the material of the workpiece between each tooth forming edge of each of the blades. The material on the external surface of the workpiece is formed around the radius of each of the tooth forming edges of each of the forming blades on a line with the configuration of each tooth forming edge. In another embodiment the apparatus includes a plurality of radially disposed, rotary type teeth forming dies.

16 Claims, 28 Drawing Figures

156
158
159
160
208
205
12
204
164
170
147
145
146
153
150
172
161
106
105
211
218
14
177
195
202
194
200
193
157
141
140

ROLL-THROUGH COLD FORMING APPARATUS

BACKGROUND OF THE INVENTION

1. Field of the Invention

This invention relates generally to the art of cold forming teeth on a workpiece and, more particularly, to a novel and improved roll-through cold forming apparatus. The invention is specifically concerned with a non-generating teeth forming apparatus for simultaneously forming a plurality of either external or internal straight spline or gear type teeth, on a cylindrical workpiece, by operatively engaging the workpiece with tooth forming edges on a plurality of teeth forming members disposed radially about said workpiece during movement of the workpiece past the teeth forming members.

2. Description of the Prior Art

It is well known in the art of cold forming teeth on the periphery of a workpiece to employ a plurality of non-generating, pivotally mounted tooth forming blades which are readily disposed around a workpiece and which are power actuated into engagement with the workpiece during a tooth forming operation. An example of such a prior art apparatus for cold forming teeth on the periphery of a workpiece is disclosed in prior U.S. Pat. No. 3,396,570 to McCardell.

A disadvantage of the tooth forming apparatus disclosed in the McCardell patent is that the teeth are formed in a workpiece by parallel forming instead of radial forming as in the present invention. That is, in forming teeth with the McCardell apparatus, each of the tooth forming blades has a parallel tooth forming edge on the workpiece engaging end thereof, and there is relative movement between the workpiece and each of the tooth forming edges which provides a great deal of sliding friction during a parallel tooth forming operation. Accordingly, in the parallel tooth forming method carried out by the McCardell apparatus, there is a high percentage of total tooth forming action in the last few degrees of rotation of each of the powered tooth forming blades, as for example, in the last ten to fifteen degrees of rotation of the blades.

The aforedescribed sliding, parallel tooth forming apparatus creates extremely high forces, both in the overall machine and in each of the tooth forming blades, as well as in the workpiece. One injurious result of said high forces created in the workpiece is that, due to the metal forming being carried out in a short time period, there is a great deal of metallurgical destruction done to the workpiece. The formation of extremely high forces created on the forming machine are incurred in the various parts thereof, which results in deflections in the machine parts, and inaccuracies in the final workpiece. In order to resist such high forces created during the forming action of the McCardell apparatus, the apparatus must have an inherent strength to resist such forces, which means increased weight and manufacturing costs in the various parts of the McCardell machine, as for example, in the transmission and drive train.

It is also well known in the prior art to form teeth on the exterior of a workpiece by providing a plurality of multiple forging or striking type tooth forming tool members which are driven in a direction perpendicular to the external side of a stationary workpiece, so as to progressively form the depth of a tooth in the external side of a workpiece. The metal in the workpiece is worked at a slower rate than in the aforementioned McCardell apparatus, but the continual hammering or kneading type effect produced by the forging type prior art machine creates the problem of workpiece hardening as such forming operation is carried out.

SUMMARY OF THE INVENTION

In accordance with the present invention, the roll-through cold forming apparatus is adapted for cold forming straight spline teeth, either externally or internally on a tubular workpiece. The forming apparatus of the present invention is also adapted to simultaneously form internal and external teeth on a tubular workpiece. In one embodiment, the apparatus includes a plurality of radially disposed, pivotally mounted teeth forming blades which are disposed around the axis of movement of a linearly movable ram carrying a workpiece, whereby when the ram moves in one direction past the teeth forming blades, the blades are engaged by an interference contact with the workpiece carried on the ram. Continued movement of the ram rolls the teeth forming blades over the external surface of the workpiece so as to displace the material of the workpiece around the radius of each tooth forming edge on each of the forming blades, without any sliding engagement with the workpiece. In another embodiment of the invention, the cold forming apparatus includes a plurality of radially disposed, rotary type teeth forming blades or guides that are moved into a rolling, teeth forming engagement with a workpiece carried on a ram which functions in the same manner as the movable ram of the first above described embodiment.

The roll-through cold forming apparatus of the present invention includes a housing means, and means for movably mounting a mandrel on said housing means for movement along the longitudinal axis of the mandrel. A plurality of tooth forming blades are disposed in a circle about the longitudinal axis of the mandrel in spaced apart radial positions. Each of the tooth forming blades has at least one tooth forming edge thereon, although they may have two of such tooth forming edges or more, up to a total of about six of such tooth forming edges.

Each of the forming blades of the first embodiment are pivotally mounted, and they are adjustable inwardly toward the mandrel for adjusting the depth of the teeth formed on a workpiece on the mandrel. Each of the rotary forming blades of the second embodiment are rotatably mounted, but they are also adjustable inwardly toward the mandrel for adjusting the depth of the teeth formed on a workpiece on the mandrel.

The mandrel is carried on a power driven shaft which moves the mandrel from an initial position through a teeth forming operation in one direction, and then back to said initial position. A stripper means is carried by the mandrel and is adapted to remove a finished workpiece from the mandrel, and to load a new workpiece on the mandrel. A power drive means is operatively connected to the stripper means for operating the same.

Other features and advantages of this invention will be apparent from the following detailed description, appended claims, and the accompanying drawings.

DETAILED DESCRIPTION OF THE PREFERRED EMBODIMENTS

Figure 2:
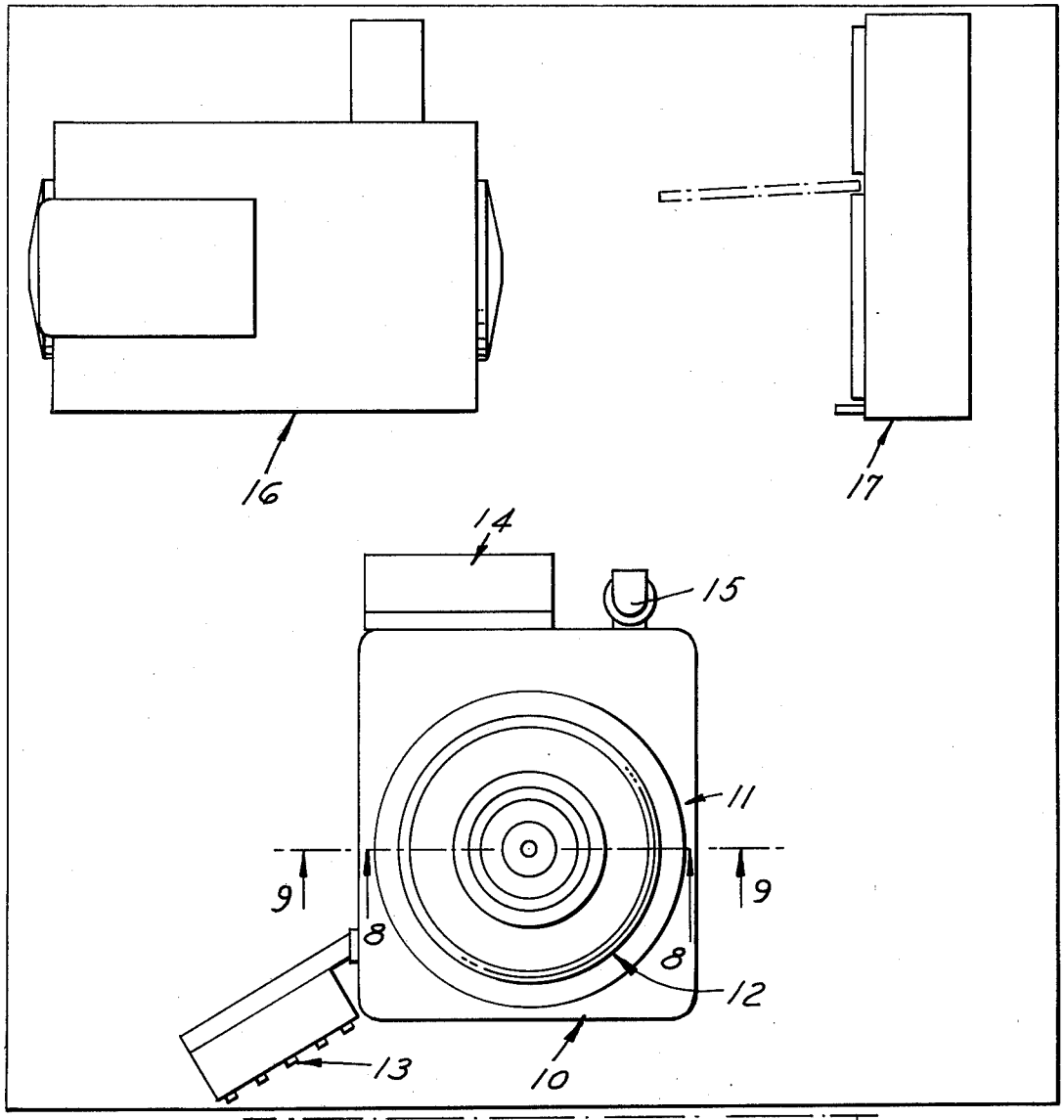
FIG. 2 is a top plan view of the roll-through cold forming apparatus illustrated in FIG. 1, taken along the line 2—2 thereof, and looking in the direction of the arrows.
Figure 1:
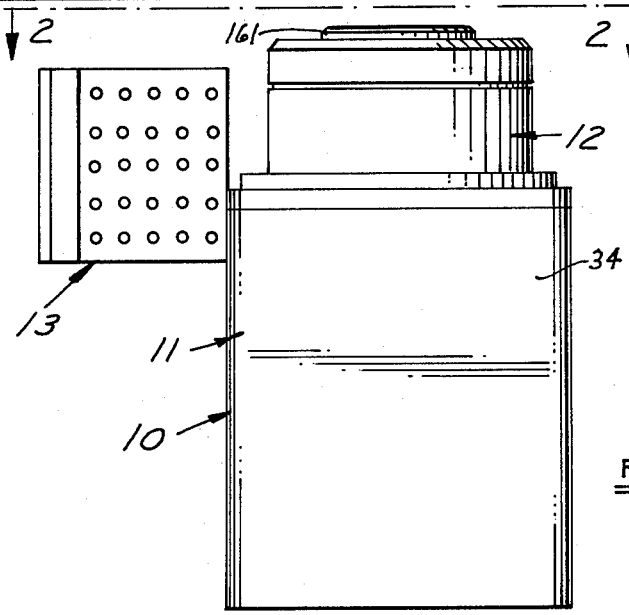
FIG. 1 is a side elevation view of a roll-through cold forming apparatus made in accordance with the principles of the present invention for forming external teeth on a part

Referring now to the drawings, and in particular to FIG. 1, the numeral 10 generally designates a roll-through cold forming apparatus which includes a lower housing 11, and an upper housing or forming head 12. FIG. 1 shows a top plan floor view of the roll-through cold forming apparatus 10 with an associated operator's push button panel generally indicated by the numeral 13, a hydraulic valve panel generally indicated by the numeral 14, a coolant pump generally indicated by the numeral 15, and a hydraulic power pack assembly generally indicated by the numeral 16. The apparatus of the present invention is also provided with an electric control panel generally indicated by the numeral 17.

Figure 3:
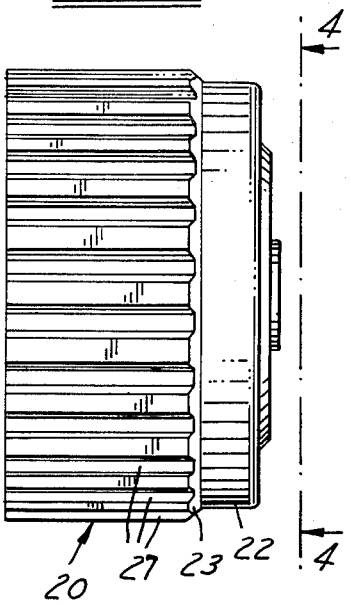
FIG. 3 is a side view of a finished part having an exterior configuration which was formed with the apparatus illustrated in FIG. 1.
Figure 4:
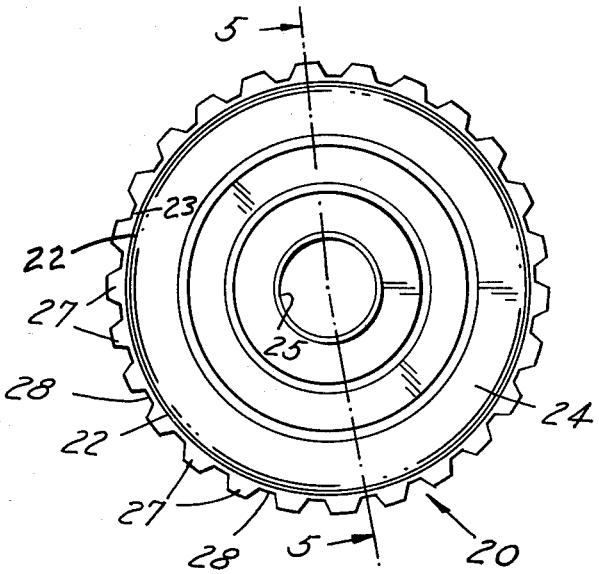
FIG. 4 is a front elevation view of the part illustrated in FIG. 3, taken along the line 4—4 thereof, and looking in the direction of the arrows.
Figure 5:
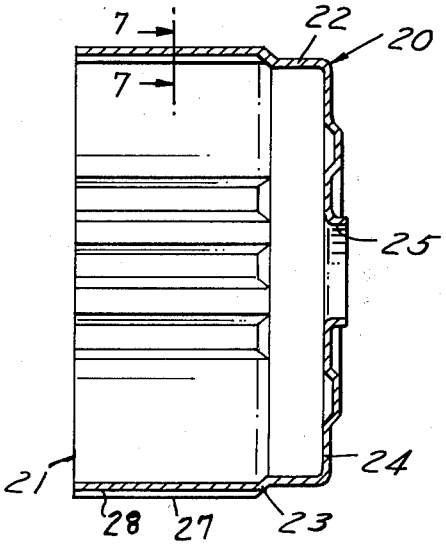
FIG. 5 is an elevation section view of the finished part illustrated in FIG. 4, taken along the line 5—5 thereof, and looking in the direction of the arrows.

FIGS. 3, 4 and 5 show a cup-shaped part or workpiece, generally indicated by the numeral 20, on which straight spline teeth 27 are formed, or any other teeth without re-entry curves, by the roll through cold forming apparatus of the present invention. The part 20 is cylindrical and it is open at one end thereof as indicated by the numeral 21. The part 20 is enclosed by a transverse end wall 24 at the other end thereof. An axial hole 25 is formed through the end wall 24. The straight spline teeth 27 are formed in the part cylindrical side wall 22. The teeth 27 extend from the open end 21 of the part toward the end wall 24, and they terminate at a tapered annular shoulder 23.

Figure 7:
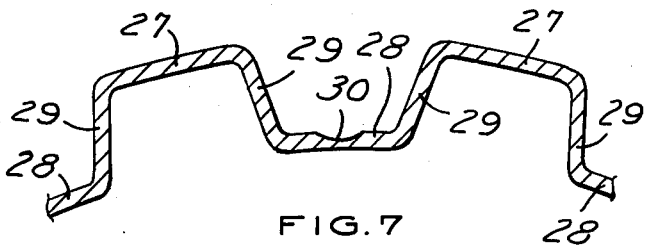
FIG. 7 is an enlarged, fragmentary, elevation section view of the work part structure illustrated in FIG. 5, taken along the line 7—7 thereof, and looking in the direction of the arrows.

FIG. 7 shows a fragmentary cross section view of the spline teeth 27. As shown in FIG. 7, each of the spline teeth 27 includes the tapered side walls 29 which extend inwardly to the root portion 28 of each tooth. A longitudinal indentation 30 is formed in the root portion 28 of each of the teeth 27 during the formation of the teeth 27, in order to insure that the metal is driven into the corners of the mating mandrel teeth, as more fully described hereinafter to produce the correct outer configuration of the spline teeth 27.

Figure 8:
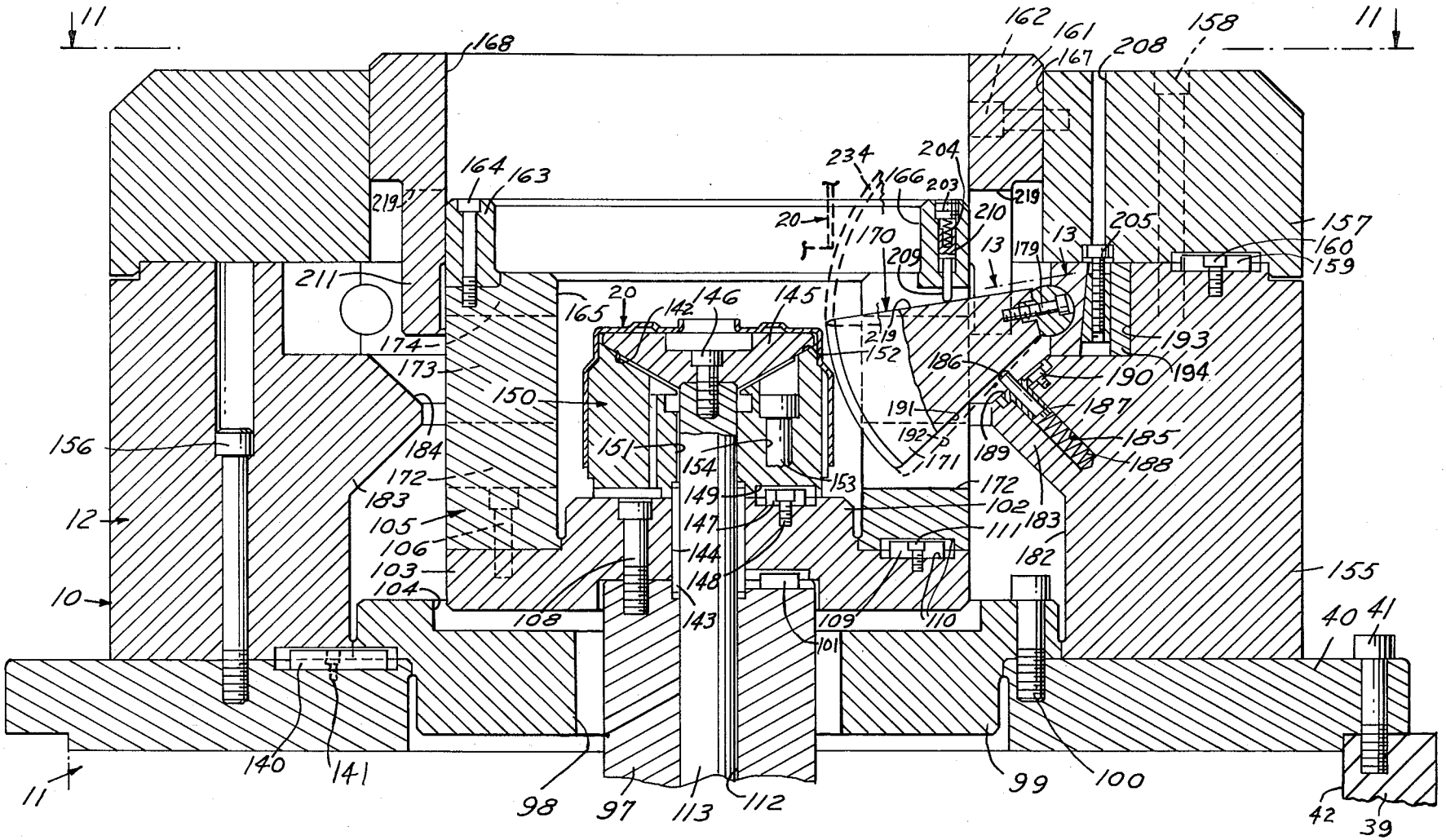
FIG. 8 is a fragmentary, enlarged, elevation section view of the roll-through cold forming apparatus shown in FIG. 2, taken along the line 8—8 thereof, and looking in the direction of the arrows.
Figure 9:
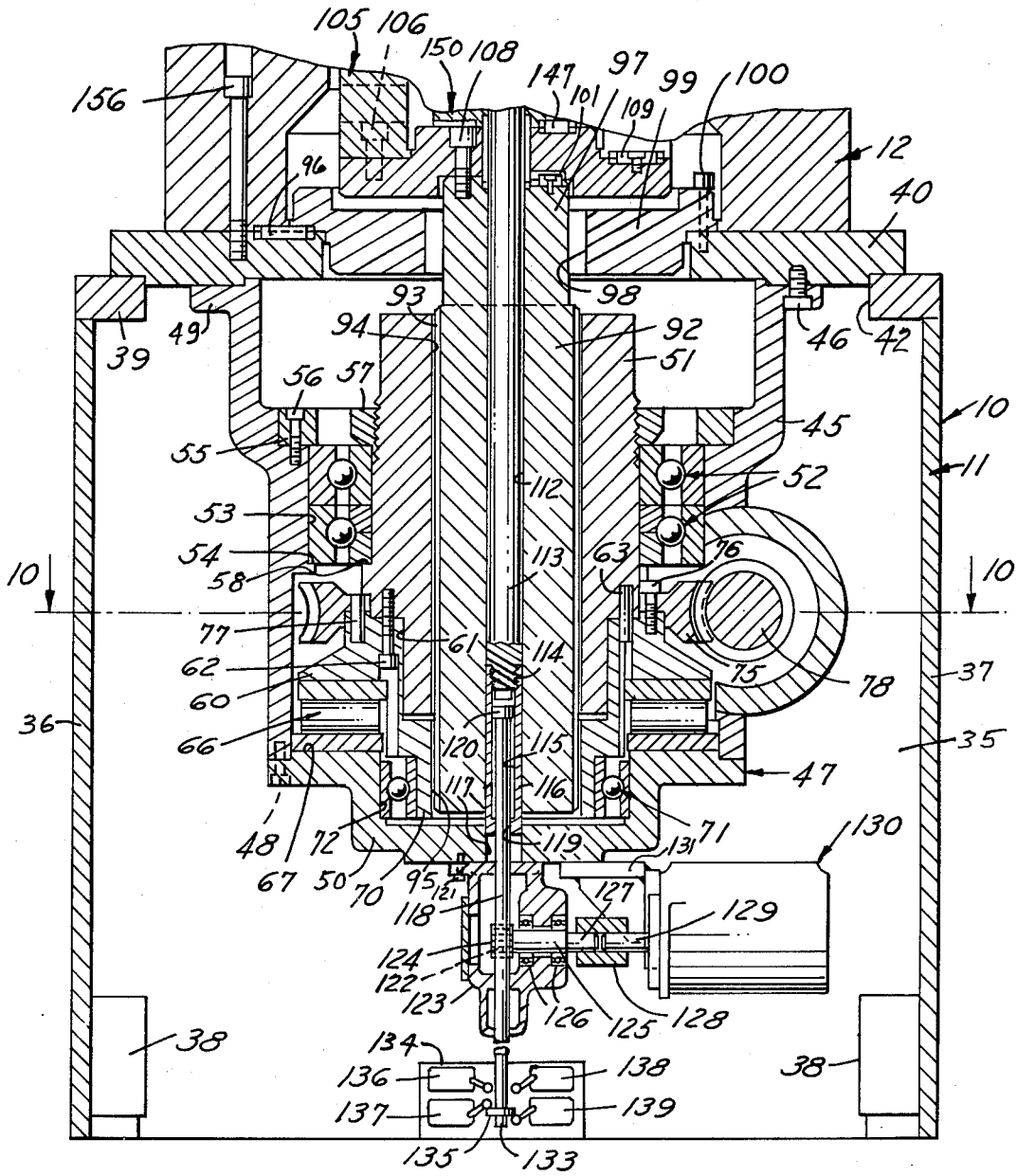
FIG. 9 is a fragmentary, enlarged, elevation section view of the roll-through cold forming apparatus shown in FIG. 2, taken along the line 9—9 thereof, and looking in the direction of the arrows.
Figure 10:
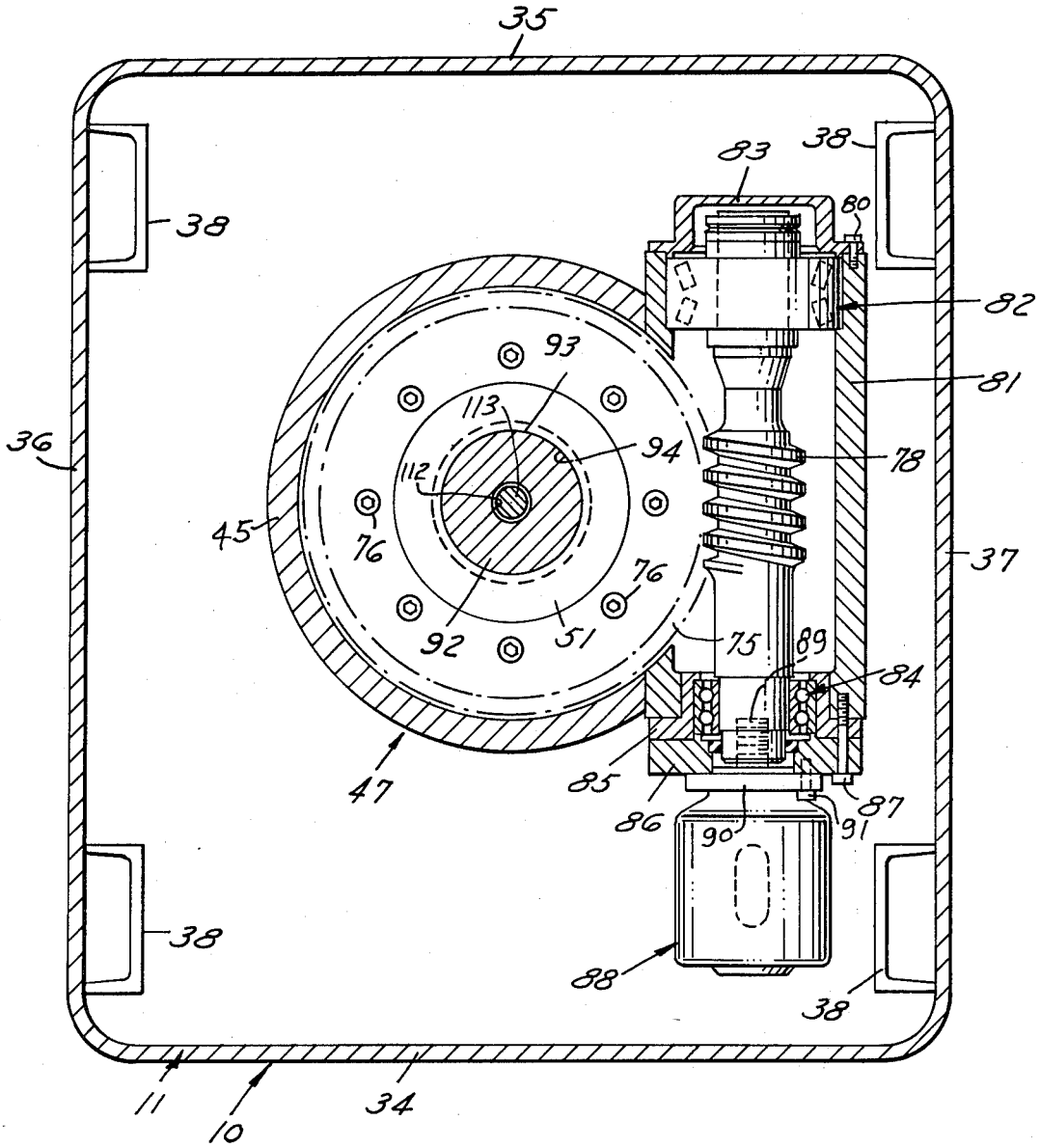
FIG. 10 is a horizontal section view of the roll-through cold forming apparatus illustrated in FIG. 9, taken along the line 10—10 thereof, and looking in the direction of the arrows.

As shown in FIG. 10, the lower housing or base 11 is square in cross section and includes the integral side walls 34, 35, 36 and 37. The lower housing 11 is further provided with channel shaped, vertically disposed foot pads 38 at each corner of the housing 11. As shown in FIG. 9, the upper end of the housing 11 is enclosed by a top wall plate 39 through which is formed a circular opening 42. As shown in FIG. 9, a circular adapter plate 40 is seated on the housing top wall plate 39, and it is secured thereto by suitable machine screws 41, as shown in FIG. 8.

As shown in FIG. 9, the roll-through cold forming apparatus 10 includes a drive housing, generally indicated by the numeral 47, which is fixedly mounted within the lower housing 11. As shown in FIG. 9, the drive housing 47 includes a cylindrical housing body 45 which is open at the upper end and provided with an external, integral, peripheral mounting flange 49. The mounting flange 49 is secured to the lower face of the circular adaptor plate 40 by any suitable means, as by a plurality of suitable machine screws 46. The lower end of the cylindrical housing body 45 is enclosed by a stepped end wall 50 which is secured to the lower end of the cylindrical housing body 45 by any suitable means, as by a plurality of suitable machine screws 48.

An elongated, stationary, cylindrical rotary nut 51 is rotatably mounted within the cylindrical housing body 45 by a pair of suitable ball bearing sets, generally designated by the numeral 52. The ball bearing sets 52 are operatively seated around the rotary nut 51, and they are mounted in a cylindrical chamber 53 formed in the cylindrical housing body 45. The outer race of the lower ball bearing set 52 is seated on a shoulder 54 formed at the lower end of the cylindrical chamber 53. The inner race of the lower ball bearing set 52 is seated on a similar shoulder 58 formed on the outer surface of the rotary nut 51. The outer race of the upper ball bearing set 52 is secured in place within the housing body 45 by a retainer ring 55 which is held in place by a plurality of suitable machine screws 56. The inner race of the upper ball bearing set 52 is retained in place by a suitable threaded retainer nut 57 which is threadably mounted around the upper end of the rotary nut 51.

As shown in FIG. 9, a carrier ring 60 is operatively mounted around a reduced diameter lower end of the rotary nut 51, and it is secured thereto by a plurality of suitable machine screws 62 and a dowel pin 63. The lower end of the carrier ring 60 is rotatably supported by a suitable roller thrust bearing means, generally indicated by the numeral 66, which has its lower race seated on the upper surface 67 of a portion of the stepped housing end wall 50. The carrier ring 60 includes a reduced diameter portion 70 which is stepped inwardly below the lower end of the rotary nut 51 and which has an outer reduced diameter periphery on which is operatively mounted a suitable ball bearing means, generally indicated by the numeral 71. The ball bearing means 71 is operatively seated in a cylindrical chamber 72 formed in the housing stepped end wall 50.

As shown in FIG. 9, a worm wheel 75 is mounted around the rotary nut 51, and it is secured to the upper end of the carrier ring 60 by a plurality of suitable machine screws 76 and a suitable dowel pin 77. As shown in FIGS. 9 and 10, the worm wheel 75 is meshed with and driven by a drive worm 78. As shown in FIG. 10, the drive worm 78 is rotatably supported with a suitable housing 81 which is fixed by any suitable means, as by welding in an opening in a side of the drive housing 45, as shown in FIG. 9.

As shown in FIG. 10, one end of the drive worm 78 is supported in the housing 81, at one end thereof, by a suitable thrust bearing means, generally indicated by the numeral 82. The bearing means 82 is enclosed by a housing end cover 83 which is fixedly secured to the housing 81 by a plurality of suitable machine screws 80. The other end of the drive worm 78 is rotatably supported at the other end of the housing 81 by a suitable roller bearing means, generally indicated by the numeral 84. The bearing means 84 is operatively supported by a suitable cylindrical carrier member 85 which is enclosed by a retainer collar 86. The retainer collar 86 is secured to said other end of the housing 81 by a plurality of suitable machine screws 87. A suitable hydraulic drive motor, generally indicated by the numeral 88, has an output shaft 89 operatively secured by any suitable means to the end of the drive worm 78 that is supported by the bearing means 84. The drive motor 88 carries a mounting flange 90 which is secured by suitable machine screws 91 to the outer face of the retainer collar 86.

As shown in FIG. 9, an elongated, cylindrical, externally threaded ram 92 is provided with an external thread 93, and it is threadably mounted in a threaded axial bore 94 that is formed through the rotary nut 51. The lower threaded end of the ram 92 is also threadably mounted in the threaded inner bore 95 of the carrier ring sleeve portion 70. The threaded ram 92 is provided on its upper end with a non-threaded, reduced diameter portion 97 which is extended through an enlarged axial hole 98 that is formed through a circular adaptor plate 99. The adaptor plate 99 is fixedly secured to the adaptor plate 40 by a plurality of suitable machine screws 100 and a suitable key 96.

As shown in FIG. 8, a ram top plate 103 is provided with an axial recess, on the lower end thereof, in which is seated the upper end 97 of the ram 92. The ram plate 103 extends down into an annular recess 104 which is formed in the upper end of the adaptor plate 99 when the ram 92 is in its lowered position as shown in FIG. 8. The adaptor plate 103 is provided with an integral, central upwardly extended hub portion 102. The ram top plate 103 is secured to the top end 97 of the ram 92 by a plurality of suitable machine screws 108 and a suitable key 101.

Figure 11:
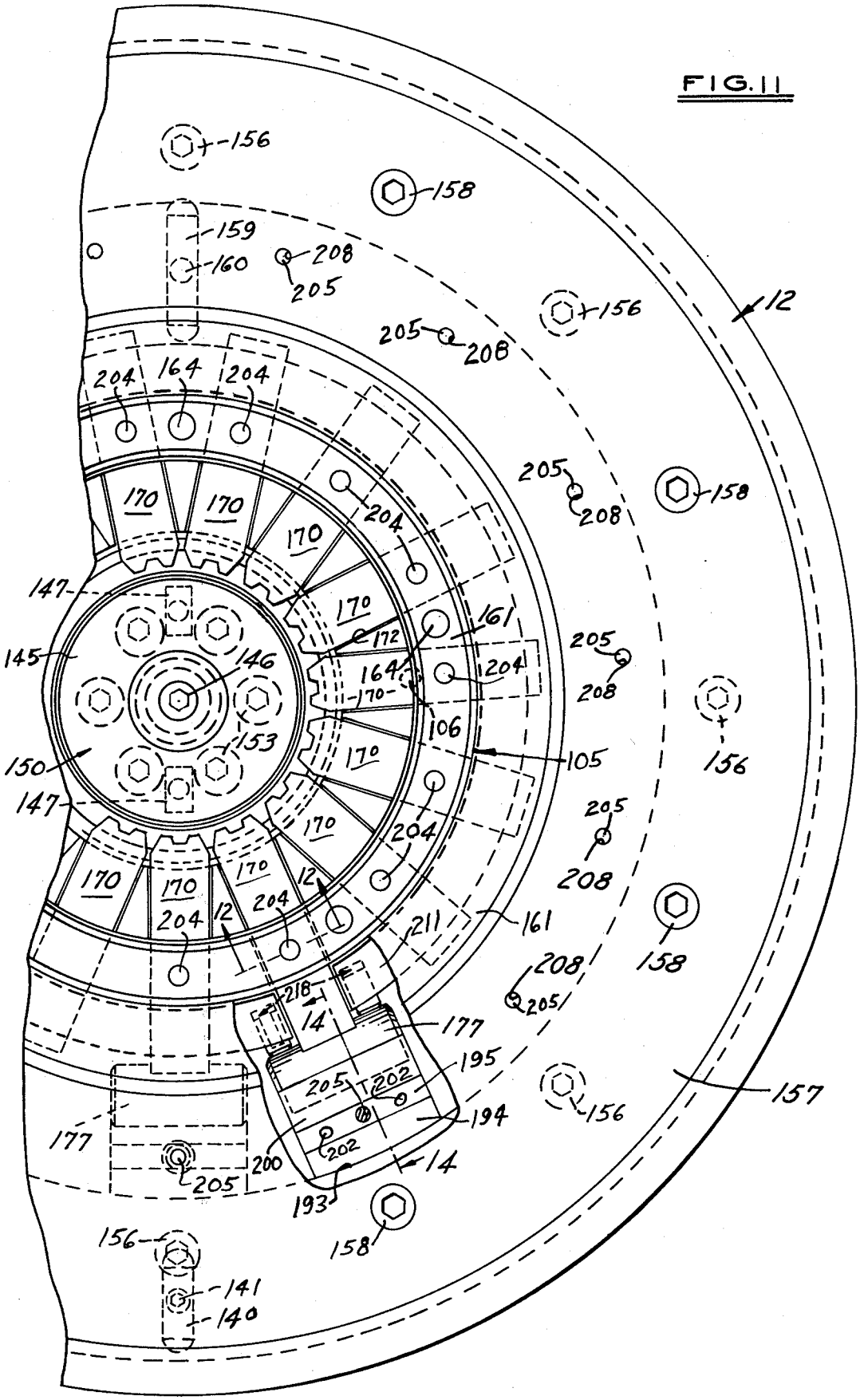
FIG. 11 is a fragmentary, top plan view of the roll-through cold forming apparatus illustrated in FIG. 8, taken along the line 11—11 thereof, and looking in the direction of the arrows.
Figure 12:
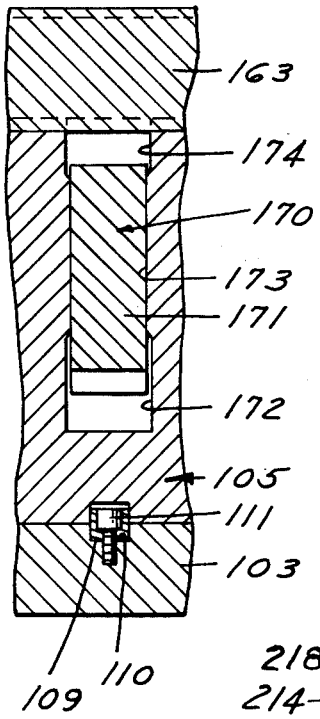
FIG. 12 is a fragmentary, enlarged, elevation section view of the structure illustrated in FIG. 11, taken along the line 12—12 thereof, and looking in the direction of the arrows.

As shown in FIG. 8, the movable ram structure includes a cylindrical forming blade guide sleeve, generally indicated by the numeral 105. As shown in FIGS. 8 and 11, the forming blade guide sleeve 105 is secured to the ram top plate 103 by a plurality of suitable machine screws 106. The forming blade guide sleeve 105 is provided with a plurality of radially disposed, longitudinally extended slots, which each receive a single tooth forming blade 170 for guiding the same in its swinging movement, as illustrated in FIG. 12. As shown in FIG. 12, each of said forming blade guide slots is formed with a stepped width shape, as indicated by the upper and lower portions 170 and 174, respectively, which are wider than the intermediate slot portion 173. The aforementioned machine screws 106 for securing the forming blade guide sleeve to the ram top plate 103 are disposed in the lower slot portions 172 of certain of said forming blade guide slots. As shown in FIGS. 8 and 12, the forming blade guide sleeve 105 is also secured to the ram top plate 103 by a suitable key 109 which is positioned in mating guide slots 110 formed in the adjacent ram top plate 103 and the guide sleeve 105. The key 109 is secured in place by a suitable machine screw 111.

As shown in FIGS. 8 and 9, the rams 92 is provided with an axial bore 112 in which is slidably mounted an elongated cylindrical stripper drive shaft 113. As shown in FIG. 9, the stripper drive shaft 113 is operated upwardly and downwardly relative to the ram 92 by a smaller diameter rack shaft 118. The stripper drive shaft 113 is provided at its lower end with a reduced diameter threaded end 114 on which is threadably mounted the upper internally threaded end of a tubular extension stripper shaft 116. The extension shaft 116 is slidably mounted through the ram 92, and it has its lower end slidably mounted in the bore 117 formed in the stepped end wall 50 of the housing 47. The rack shaft 118 is slidably mounted through a bore 119 formed through a lower end wall on the extension shaft 116. The upper end of the rack shaft 118 is provided with an enlarged head 120 which is slidably mounted within the longitudinal cylindrical chamber 115 formed in the extension shaft 116.

As shown in FIG. 9, the lower end of the rack shaft 118 is extended downwardly into a suitable drive pinion housing 123 which is secured to the lower end of the housing stepped end wall 50 by any suitable means, as by suitable machine screws 121. The rack shaft 118 is provided on one side thereof with a longitudinally extended pinion rack 122 which is meshed with a drive pinion 124. The drive pinion 124 is operatively fixed on one end of a shaft 125 which is rotatably mounted on a pair of suitable ball bearing means 126 carried in the housing 123. The shaft 125 is provided with a reduced diameter end 127 which extends outwardly of the housing 123. The shaft end 127 is operatively connected by a suitable coupling 128 to the output shaft 129 of a suitable hydraulic drive motor, generally indicated by the numeral 130. The hydraulic drive motor 130 is secured to the stepped end housing wall 50 by a mounting plate 131, which is secured to the motor 130 and to the housing wall 50 by any suitable means.

The rack shaft 118 is provided on its lower end 133 with a limit switch operator flange 135 for operating a plurality of limit switches 136, 137, 138, and 139 during operation of the parts stripper shaft 113, as more fully explained hereinafter. The limit switches 136 through 139 are supported on a suitable mounting plate 134 which is attached by any suitable means to the lower housing 11.

As seen in FIG. 8, a parts carrier and stripper head 145 is secured to the upper end of the parts stripper shaft 113 by a suitable machine screw 146. The parts carrier and stripper head 145 is shaped as an inverted cone, and has a conical lower end face 142. As shown in FIG. 8, the upper end of the stripper shaft 113 is slidably supported by a sleeve bearing 143 which is operatively mounted in an axial bore 144 that is formed through the ram top plate 103.

Figure 18:
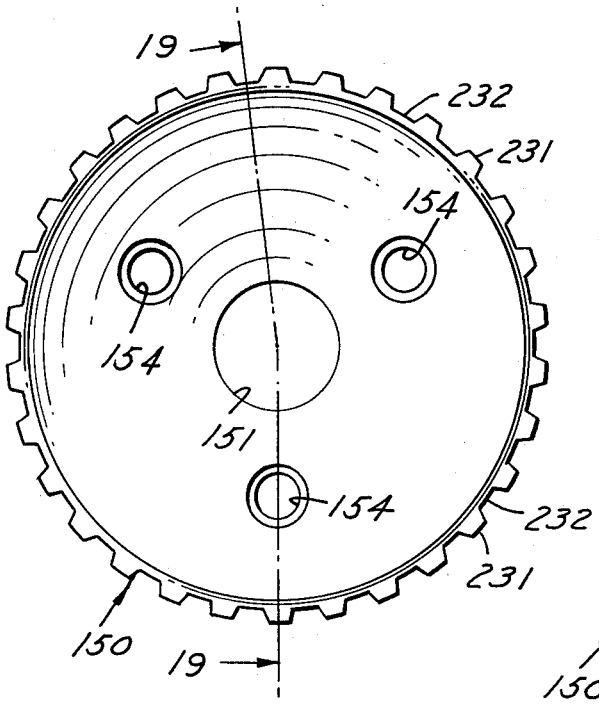
FIG. 18 is a top end view of a forming mandrel for forming a plurality of external straight spline teeth on a part.
Figure 19:
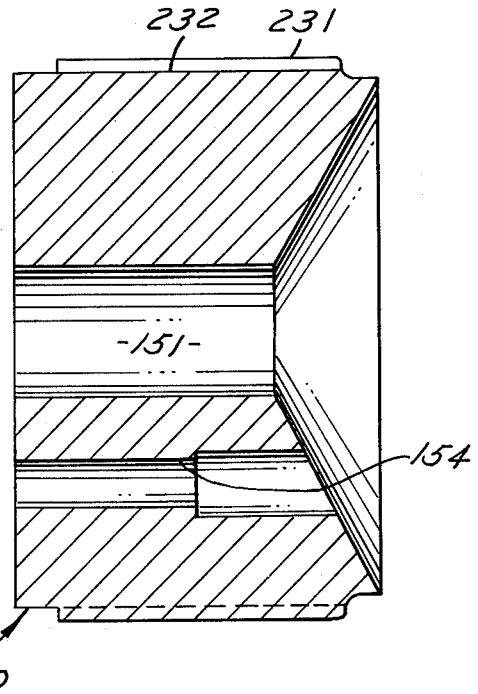
FIG. 19 is a section view through the straight spline teeth forming mandrel of FIG. 18, taken along the line 19—19 thereof, and looking in the direction of the arrows.

As shown in FIG. 8, a tooth forming internal head or mandrel, generally indicated by the numeral 150 is fixedly secured to the hub portion 102 of the ram top plate 103 by a plurality of suitable machine screws 153 which extend through the counterbored holes 154 in the mandrel 150 (FIGS. 18, 19). The mandrel 150 is also located in place by a pair of suitable keys 147, as shown in FIG. 11. As shown in FIG. 8, a detailed mounting of one of the keys 147 is shown. It will be understood that the other key 147 is similarly mounted. The key 147 is mounted in mating key slots 149 formed in the mandrel 150 and the ram top plate hub portion 102. The key 147 is secured to the ram top plate hub portion by a suitable machine screw 148.

As shown in FIG. 8, the stripper shaft 113 is movably mounted through an axial bore 151 formed through the mandrel 150. The upper end 152 of the mandrel 150 is shaped as an inverted cone, so as to form a mating seat for the conically shaped lower end surface 142 of the stripper head 145.

As shown in FIGS. 8 and 11, the upper housing 12 includes a cylindrical forming blade support housing 155 which has its lower end seated on the upper side of the adaptor plate 40, and which is secured thereto by a plurality of suitable machine screws 156. The forming blade support housing 155 is also secured in place by a suitable key 140 which is secured in suitable mating slots in the housing 155 and the adaptor plate 40 by a suitable machine screw 141. The upper housing 12 further includes a circular retainer housing 157 which is operatively mounted on top of the forming blade support housing 155, and which is secured thereto by a plurality of suitable machine screws 158. The retainer housing 157 is further located in place by a key 159 (FIG. 8) which is mounted in suitable mating recesses in the retainer housing 157 and the support housing 155 and secured in place by a suitable machine screw 160.

As shown in FIGS. 8 and 11, a stationary ring shaped guide bushing 161 is secured within a bore 167 of the retainer housing 157 by a plurality of suitable machine screws 162. A movable guide bushing 163 is slidably mounted within the bore 168 of the stationary guide bushing 161. The movably guide bushing 163 is secured by a plurality of machine screws 164 to the top end of the forming blade guide sleeve 105. As shown in FIG. 8, the internal forming hub or mandrel 150 is seated within the bore 165 of the forming guide sleeve 105. The movable guide bushing 163 is provided with a bore 166 which is larger in diameter than the diameter of the bore 165 and which communicates with the bore 165.

As shown in FIG. 11, a plurality of radially disposed tooth forming blades, generally indicated by the numeral 170, are mounted around the mandrel 150, and they are each provided with a blade-like body 171. The blade bodies 171 are each disposed on a plane perpendicular to the axis of travel of the forming mandrel 150. As shown in FIGS. 8 and 12, each of the tooth forming blades 170 is movably mounted and retained within an elongated slot formed in the guide sleeve 105. Said guide sleeve slots each comprise the three communicating slot portions 172, 173 and 174. It will be seen from FIG. 12 that the intermediate slot portions 173 provide a close sliding relationship with the sides of the blade body 171 of each of the forming blades for giving the same lateral support during a tooth forming operation.

Figure 13:
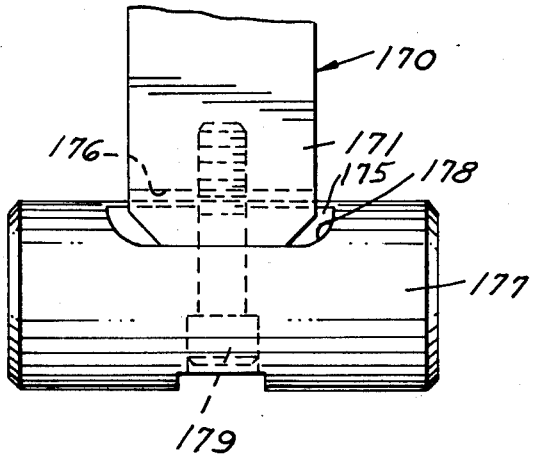
FIG. 13 is a fragmentary, enlarged, elevation view of a portion of the structure illustrated in FIG. 8, taken along the line 13—13 thereof, and looking in the direction of the arrows.
Figure 14:
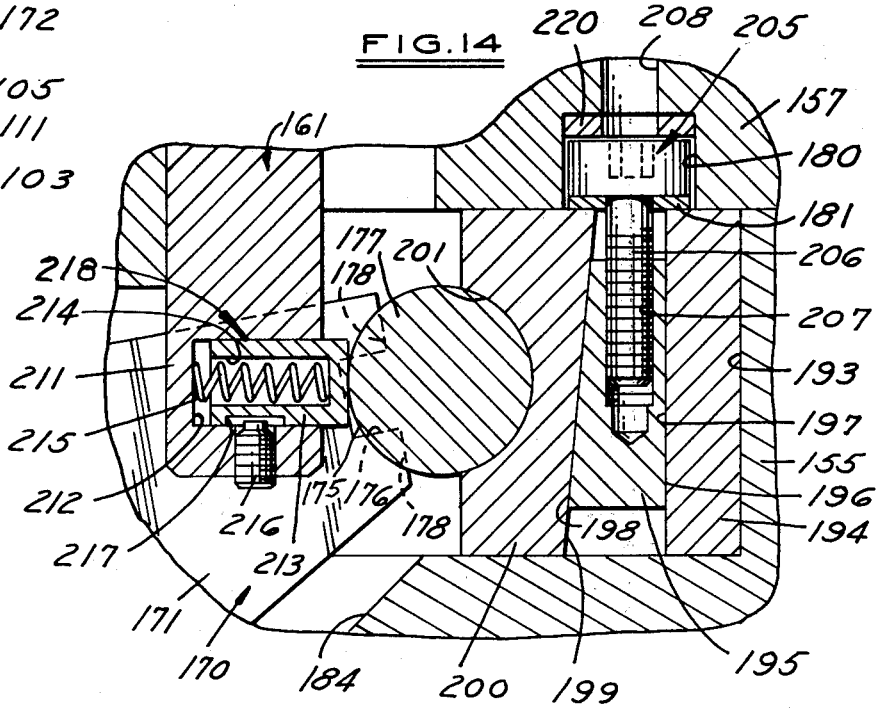
FIG. 14 is a fragmentary, enlarged, elevation section view of the structure illustrated in FIG. 11, taken along the line 14—14 thereof, and looking in the direction of the arrows.

As shown generally in FIGS. 8 and 11, and in more detail in FIGS. 13 and 14, each of the forming blades 170 is pivotally mounted at its outer or rear end on a transversely disposed pivot pin 177. The outer or rear end of each of the forming blade bodies 171 is provided with a rectangular recess 176 which is adapted to receive a mating shoulder 175 on the side of an adjacent pivot pin 177. The shoulder 175 is formed by a pair of spaced apart cut-outs or recesses 178. Each of the blades 170 is secured to its respective pivot pin 177 by a suitable machine screw 179.

As shown in FIG. 8, the forming blade support housing 155 has a chamber 182 formed therein which surrounds the forming blade guide sleeve 105. The support housing 155 has a round shaped protrusion 183 extending into the chamber 182 to a point closely spaced apart from the guide sleeve 105. A downwardly sloping surface 184 is formed on the upper side of the protrusion 183. Movably mounted within the protrusion 183 is a plurality of spring biased return pins 186. The sloping surface 184 is formed on an angle of about 45° relative to the axis of the ram 92. Each of the return pins 186 is adapted to engage the lower angled side 191 of an adjacently disposed forming blade body surface 171. The return pins 186 are each slidably mounted in an angled bore 185 which is formed perpendicular to the angled surface 184. Each of the return pins 186 is provided with a circular head 187. One end of a suitable return spring 188 in the bore 185 is seated against the outer end of the pin head 187, and the other end of the spring 188 is seated against the wall of the lower end of the bore 185. Each of the return pins 186 is retained in its respective bore 185 by a suitable retainer member 189 which is secured in place by any suitable means, as by a suitable machine screw 190.

The broken line in FIG. 8 indicated by the numeral 192 indicates the angular position to which each of the forming blades 170 is swung downwardly by an interference engagement with the mandrel 150 as it is moved to its initial starting position shown in solid lines in FIG. 8. When the mandrel 150 has reached the initial starting position, each of the forming blades 170 is swung back upwardly in a clockwise direction, as viewed in FIG. 8, to the solid line position shown in FIG. 8, for the start of a teeth forming operation.

As shown in FIGS. 8 and 11, the forming blade support housing 155 is provided with an annular groove 193 around its upper inner end. The groove 193 terminates at its inward end at the upper edge of the angled surface 184 on the housing 155. Disposed in the annular groove 193, behind each of the forming blades 170 is an adjustable gib means for adjusting the forming blades 170 inwardly and outwardly to their desired teeth forming positions. The gib adjusting means structure for each of the forming blades 170 is the same, and one such structure is shown in FIGS. 8, 11 and 14.

As best seen in FIG. 14, each of the gib adjusting means includes a gib backing block 194 which is seated against the outer vertical surface of the groove 193. The adjustable gib 195 is slidably mounted against the inner vertical face 197 formed on the inner side of the backing block 194. The inner surface 197 of the backing block 194 would be formed parallel to the vertical wall of the groove 193 and also parallel to the axis of the movable ram 92. The gib 195 has a straight flat face 196 on the outer side thereof which is slidably mounted on the mating parallel face 197 on the inner side of the backing block 194. The inner face of the movable gib member 195 is angled, as indicated by the numeral 198, and it slopes inwardly and downwardly. The sloping face 198 of the gib 195 is mounted against the oppositely sloping face 199 on the other side of the pivot pin seat block 200.

As shown in FIG. 14, the angled outer face 199 of the seating block 200 slopes upwardly and outwardly of the support housing 155. A pivot pin seat 201 is arcuately formed in the inner face of the seat block 200 for rotatably supporting a pivot pin 177 on a pivotal axis which is disposed perpendicularly to the axis of the movable ram 92. As shown in FIG. 8, each of the forming blades 170 is pivotally mounted through a vertical slot 219 formed through the depending annular sleeve 211 on the lower end of the support guide bushing 161.

As shown in FIGS. 11 and 14, each of the pivot pins 177 is spring biased outwardly against its seat 201 by the following described pair of spring biasing means, generally indicated by the numeral 218. One of the spring biasing means 218 is shown in detail in FIG. 14, and it will be understood that the other spring biasing means 218 is similarly formed. As shown in FIG. 14, each of the spring biasing means 218 includes a bore 212 which is formed in the depending integral sleeve 211 formed on the lower end of the stationary guide housing 161. Slidably mounted in each of the bores 212 in a spring plunger 213 which includes a tubular sleeve member open on the inner end and provided on the outer end with a closed wall which bears against the curved surface of one of the ends of the adjacent pivot pin 177. A suitable spring 215 is mounted in the bore 214 of the sleeve member of plunger 213, with its inner end abutting the sleeve front end wall and the outer end abutting the inner end wall of the bore 212. A slot 217 is formed in the lower side of the tubular wall of the plunger sleeve for the reception of the inner end of a set screw 216. The set screw 216 retains the plunger 213 in its respective bore 212, yet permits the plunger 213 to slide inwardly and outwardly of the bore 212. It will be seen that each of the two springs 215, for each of the forming blades 170, biases the adjacent pivot pin 177 into operative engagement with its respective pivot pin seat 201 in the adjacent pivot pin seat block 200.

As shown in FIG. 14, the gib 195 may be adjusted upwardly and downwardly for camming the pivot pin seat block 200 inwardly or outwardly against the pressure of the adjacent springs 215 by means of a suitable machine screw, generally indicated by the numeral 205. As shown in FIG. 14, the threaded body 206 of each of the machine screws 205 is threadably mounted in a bore 207 in each of the gibs 195, whereby when each of the screws 205 is turned, the adjacent gib 195 will be moved upwardly or downwardly, depending on which direction the screw 205 is turned. The position of each of the forming blades 170 can thus be adjusted accurately. Each of the heads of the screws 205 is mounted in a recess 180 in the retainer housing 157 and is accessible from the upper end of the retainer housing 157 through a communicating bore 208. A bearing washer 181 is disposed under the heads of each of the screws 205, and a washer type spacer 220 is disposed above each of said screw heads. As shown in FIG. 11, each of the gibs 195 is guided in its longitudinal adjusting movements by a pair of suitable dowel pins 202.

As shown in FIG. 8, each of the forming blades 170 is provided with an individual positioning pin 209, which has a suitable head slidably mounted in a bore 210 formed in the guide housing 163 on an axis parallel to the axis of the movable ram 92. A suitable spring plunger means 203 is operatively mounted in each of the bores 210 for biasing the positioning pin 209 downwardly into operative engagement with the adjacent forming blade 170. A suitable set screw 204 is threadably mounted in the upper end of each of the bores 210 for adjusting the pressure on each of the spring plunger means 203. It will be understood that each of the return springs 188 is strong enough to move the adjacent forming blade 170 upwardly to the initial solid line "start" position shown in FIG. 8, against the pressure of the mating positioning pin 209 and its spring plunger means 203 operating on the upper side 219 of each respective forming blade 170.

Figure 16:
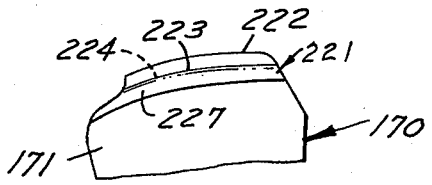
FIG. 16 is a side elevation view of the external teeth forming blade illustrated in FIG. 15, taken along the line 16—16 thereof, and looking in the direction of the arrows.
Figure 15:
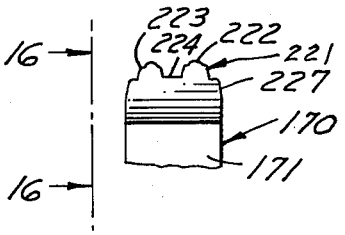
FIG. 15 is a fragmentary, top end view of a teeth forming blade for forming only external straight spline teeth on a part.
Figure 17:
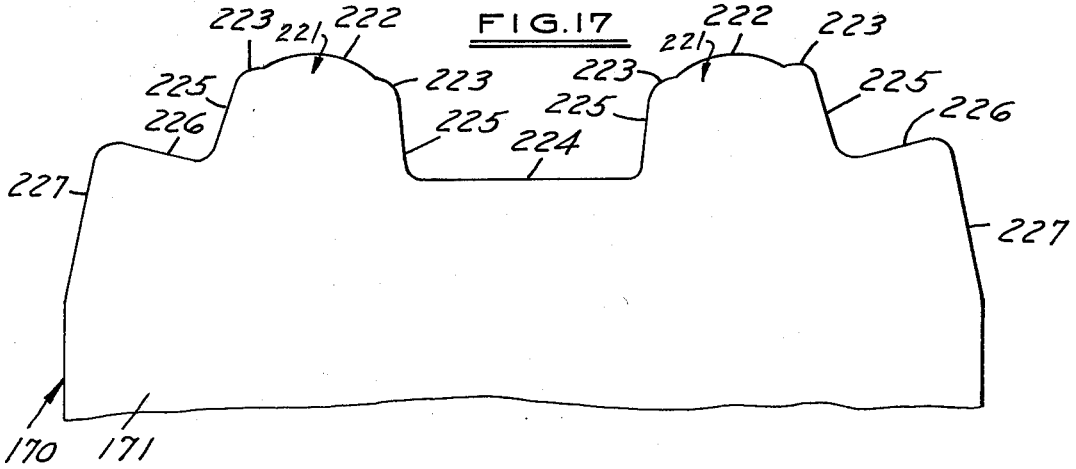
FIG. 17 is a blown-up view of FIG. 15 to show the details of the external teeth forming blade shown in FIG. 15.

FIGS. 15, 16 and 17 illustrate the structure of the teeth forming edges of each of the teeth forming blades 170. Each of the teeth forming blades 170 is provided on its outer teeth forming edge with a pair of tooth forms which are each generally indicated by the numeral 221. It will be understood that the tooth forms 221 may be shaped so as to form straight spline teeth, gear type teeth, involute spline teeth, and any other tooth form without re-entry curves.

As best seen in FIG. 17, each of the tooth forms 221 are spaced apart by a root groove 224. The outer edge of each of the teeth forms 221 is provided with a central crown or rounded portion 222 which is adapted to form a dimple 30 in the work part, as shown in FIG. 7. The crown portion 222 insures that the material of the workpiece or work part is driven into the corners of the mating tooth form on the mandrel 150 during a teeth forming operation. The outer corners of the tooth forms 221 are each provided with rounded shoulders 223 which terminate in the sloping sides 225 that in turn terminate at the root groove 224. A partial root forming groove 226 is formed on the outer side of each of the tooth forming edges on each of the blades 170 for forming one half of a root groove which is completed by an adjacent forming blade. The last mentioned half root groove 226 is terminated at the outer end thereof in a rounded edge shoulder which meets with a tapered edge 227 on the side of the blade body 171.

Figure 20:
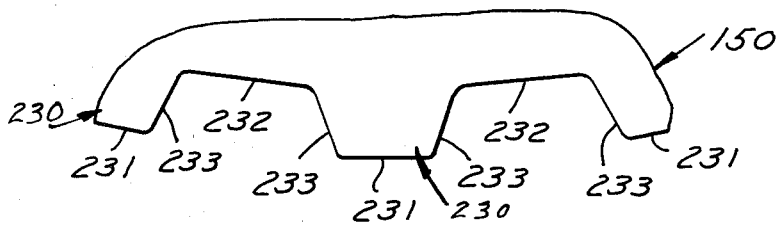
FIG. 20 is a blown-up view of a portion of the periphery of the external teeth forming mandrel of FIG. 18, and showing the details of the teeth forming mandrel periphery of FIG. 18.

FIGS. 18, 19 and 20 illustrate the details of the tooth forming peripheral edge of the mandrel 150. As shown in detail in FIG. 20, the mandrel 150 is provided around its periphery with longitudinally extended tooth forms, generally indicated by the numeral 230, which may be various tooth forms as stated hereinbefore for the tooth forming blades 170. As shown in FIG. 20, each of the tooth forms 230 on the mandrel 150 includes the outer crown edge 231 which is provided with inwardly tapered sides 233 that terminate in the adjacent root grooves 232.

The operation of the roll-through cold forming apparatus of the present invention will best be understood by reference to FIGS. 6 through 11. Assuming that the workpiece or part 20 has been previously mounted on the forming mandrel 150, and that the mandrel 150 and stripper head 145 are in the solid line position shown in FIG. 8, the motor 88 is actuated in the proper direction to drive the ram 92 upwardly into an interference driving engagement with the tooth forming edges of the plurality of teeth forming blades 170. As shown in FIG. 10, the motor 88 drives the worm 78 which in turn rotates the worm wheel 75. The worm wheel 75 in turn rotates the rotary nut 51 which in turn elevates the ram 92, and the mandrel 150 and the stripper head 145, upwardly. The tooth forming blades 170 are rotated upwardly from the solid line position shown in FIG. 8 as the mandrel 150 is driven upwardly.

It will be understood that the ram 92 moves the entire combination of the mandrel 150, the stripper head 145, the part 20, the guide sleeve 105, and the plurality of pivotally mounted tooth forming blades 170 upwardly. The tooth forming blades 170 are forced into their upward pivotal motions by their respective pivot pins 177. The upward movement of the ram 92 continues through the tooth forming cycle which is terminated or completed when the forming blades 170 move out of interference with the part 20. That is, the tooth forming cycle continues until the blades 170 move out of interference contact with the lower end of the part 20 at a blade position indicated by the dotted line position in FIGS. 6 and 8 that is marked by the numeral 234.

It will be seen that the forming blades 170 are not separately driven upwardly by any power means, other than by the interference driving action between the forming blades 170 and the workpiece 20 carried on the combination structure of the mandrel 150 and the stripper head 145. It will also be seen that the forming edge of each of the forming blades 170 rolls through an arc down to a parallel position with the surface of the workpiece during a teeth forming action, which greatly reduces the forming pressure required on the apparatus as compared to the prior art apparatus.

It will be seen that the tooth forming tools 170 are radial forming tools, as compared to the parallel forming tools of the aforementioned McCardell prior art apparatus, that is, the forming of the metal of the workpiece during a teeth forming operation is carried out around the radius of the tooth edges, on a line with the configuration of the tooth forms on the blade, rather than the area along the tooth form as carried out by said prior art McCardell apparatus. Every part of the tooth forming edge of each of the forming blades 170 functions during the tooth forming operation to provide true roll-forming in a linear plane. There is no sliding movement between the workpiece 20 and the forming tools 170 during a teeth forming operation, because the workpiece 20 and all of the forming blades 170 are moving together to provide a rolling contact with each other, rather than a sliding contact, as occurs in the aforementioned McCardell apparatus. The apparatus of the present invention functions to progressively form the depth of the teeth in the workpiece 20 so that the metal is worked under slow conditions without any injurious effect or metallurgical destruction.

It will be understood that when the combination structure of the mandrel 150 and the stripper head 145 is moved from the initial solid line position shown in FIG. 8 to the point at which the teeth forming operation is completed, that the stripper shaft 113 is moved upwardly with the ram 92 and that the rack shaft 118 that drives the stripper head 145 is inoperative and is sliding relative to the shaft 113, into the groove 115 in the stripper extension shaft 116.

Figure 6:
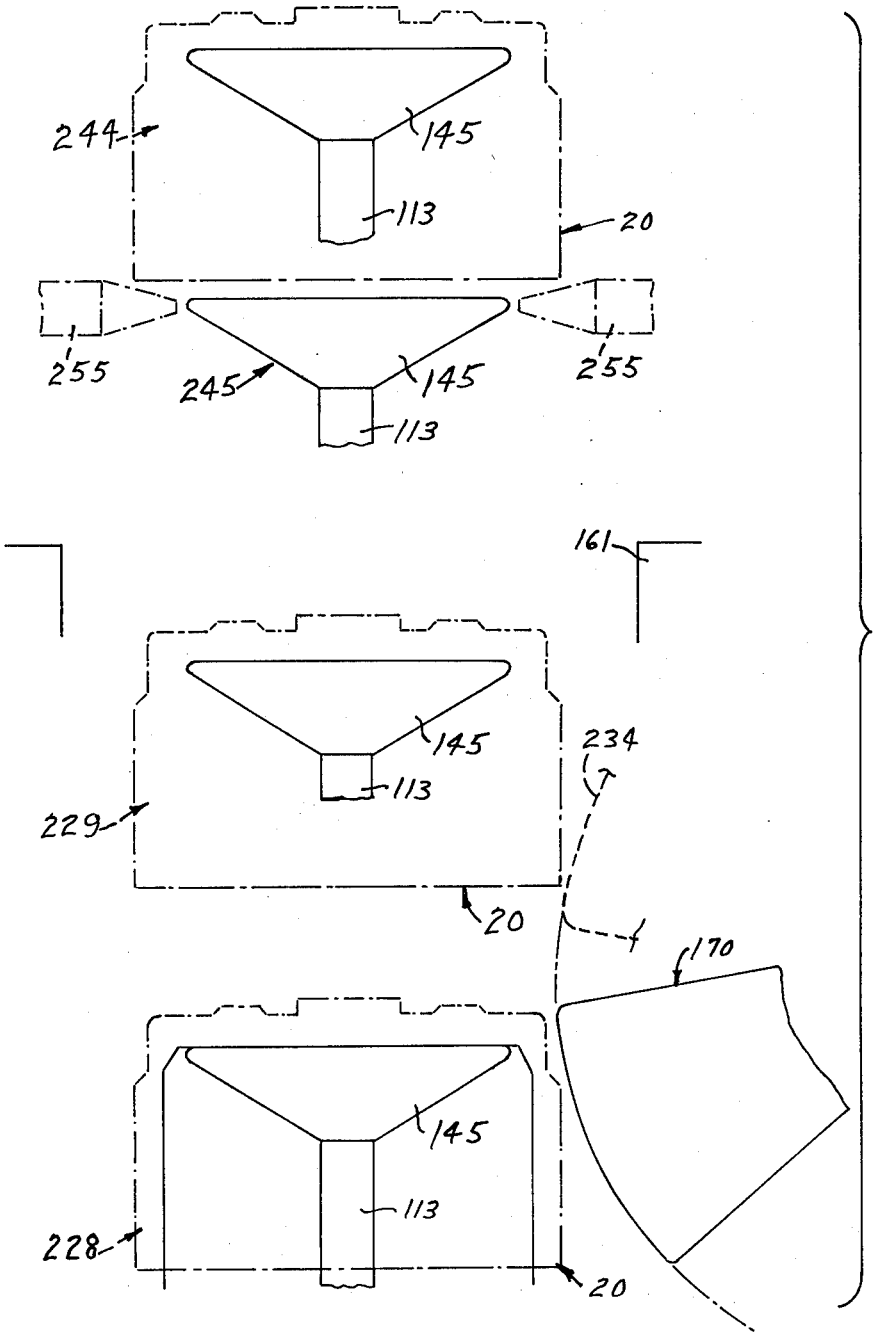
FIG. 6 is a schematic view of the sequence of the forming operations carried out by the roll-through cold forming apparatus of the present invention.

Referring to FIG. 6, the initial starting position of the mandrel 150 and the stripper head 145 is generally indicated by the numeral 228. The position of the mandrel 150 and the stripper head 145 at the point where the teeth forming operation is completed is indicated generally by the numeral 229. After the completion of the teeth forming operation, the motor 130 (FIG. 9) is actuated to drive the rack shaft 118 upwardly to engage the head 120 on the shaft 118 with the internal lower end of the stripper shaft 113 to move the stripper head 145 off of the mandrel 150 and strip the finished part 20 from the mandrel 150 and raise it up to the discharge position, generally indicated by the numeral 244, in FIG. 6. The motor 130 is then reversed so as to lower the stripper head 145 to the position indicated by the numeral 245 in FIG. 6 to permit the part 20 to be removed from the stripper head 145 by transfer fingers 255 and retain the finished workpiece 20 in a position for removal automatically by any suitable automation means. It will be understood that the transfer fingers 255 would be moved into a stripping position, as shown in FIG. 6, after the stripper head 145 has been moved to the position indicated by the numeral 244 in FIG. 6. It will also be understood that any suitable automation equipment may be employed for operating the transfer finger 255.

It will be understood that the transfer fingers 255 are shown schematically, and that they would form a part of the aforementioned automation means for removing a finished part 20 from the stripper head 145, and in turn deposit a new work part 20 into the position generally indicated by the numeral 244 in FIG. 6 for a subsequent mounting on the stripper head 145. It will be understood that the parts 20 can also be loaded on, and unloaded off, the stripper head 145 by a manual operation. The apparatus for unloading a finished part 20 and loading a new part 20 does not comprise any part of the present invention.

After the finished part 20 has been removed from the load and unload position 244, shown in FIG. 6, a new part 20 is moved into that position and the motor 130 again actuates the shafts 118 and 113 upwardly and moves the stripper head 145 from the position indicated by the numeral 245 to the upper position indicated by the numeral 244 to load the new workpiece 20 onto the stripper head 145. The motor 130 is then reversed to bring the stripper head 145 downwardly, and the new workpiece 20, to the position 229 at which point the drive motor 88 would then be actuated to also function simultaneously to continue the downward movement of the combination of the mandrel 150 and stripper head 145 to the initial starting position indicated by the numeral 228 in FIG. 6. It will be understood that when the new part is moved downwardly to the initial position 228 in FIG. 6 that the forming fingers 170 will be carried downwardly to the broken line position indicated by the numeral 192 in FIG. 8, after which they will be moved upwardly by the return pins 186 to the solid line initial starting position shown in FIG. 8.

It will be understood that any suitable electrical-hydraulic control system may be employed for operating the aforementioned various moving parts of the apparatus of the present invention to carry out the aforedescribed sequence of operations.

Figure 22:
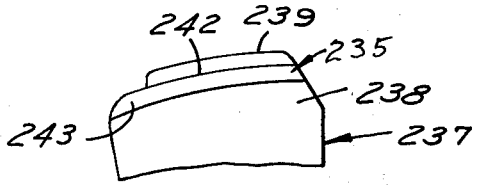
FIG. 22 is a side elevation view of the external teeth forming blade illustrated in FIG. 21, taken along the line 22—22 thereof, and looking in the direction of the arrows.
Figure 21:
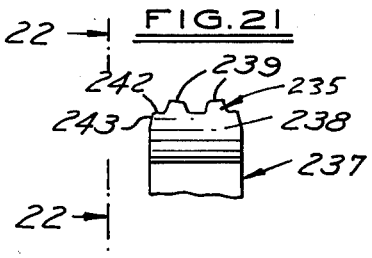
FIG. 21 is a fragmentary top end view of a teeth forming blade for forming external straight spline teeth on a part simultaneously with the formation of internal straight spline teeth on the part.
Figure 23:
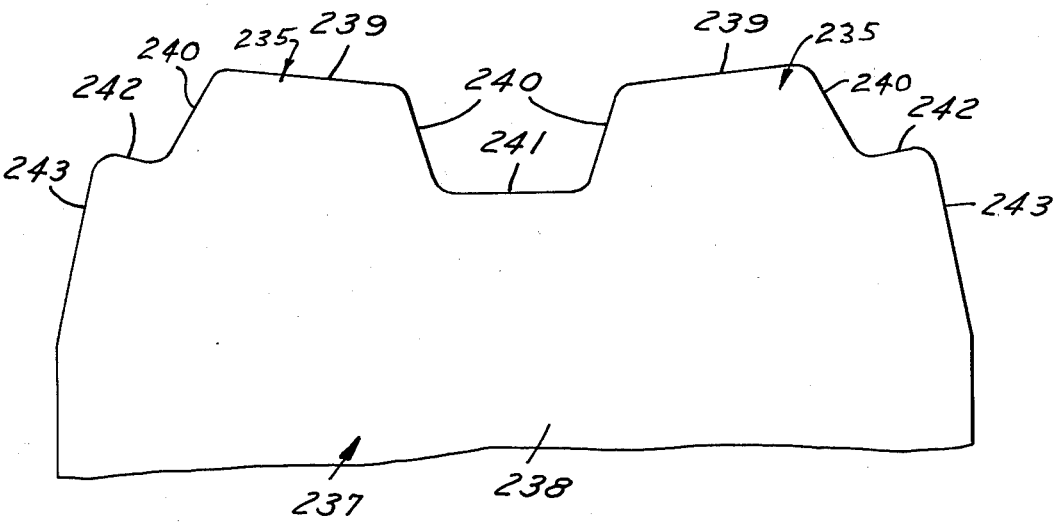
FIG. 23 is a blown-up view of FIG. 21 to show the details of the external teeth forming blade shown in FIG. 21.

FIGS. 21, 22 and 23 illustrate the structure of the teeth forming edges of each of the teeth forming blades, generally indicated by the numerals 237, for forming internal straight spline teeth on the inner surface of a tubular workpiece similar to the workpiece 20 of the first described embodiment. Each of the teeth forming blades 237 is provided on its outer teeth forming edge with a pair of tooth forms which are each indicated generally by the numeral 235.

As best seen in FIG. 23, each of the tooth forms 235 is spaced apart by a root groove 241. The outer edge of each tooth form 235 is indicated by the numeral 239, and the tapered sides of the tooth forms 235 are indicated by the numeral 240. A partial root forming groove 242 is formed on the outer side of each of the tooth forming edges of the blade bodies 238 for forming one half of a root groove which is completed by an adjacent forming blade 237. The last mentioned half root groove 242 is terminated at the outer end thereof in a rounded edge shoulder which meets with a tapered edge 243 on the side of the blade body 238.

Figure 25:
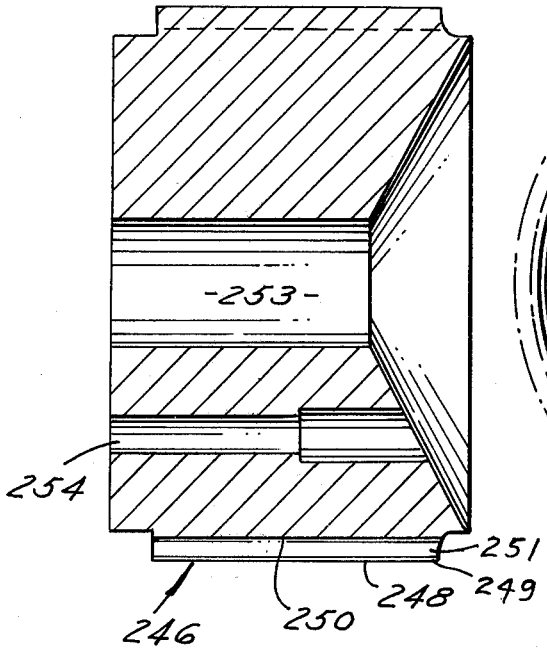
FIG. 25 is a section view through the straight spline teeth forming mandrel of FIG. 24, taken along the line 25—25 thereof, and looking in the direction of the arrows.
Figure 24:
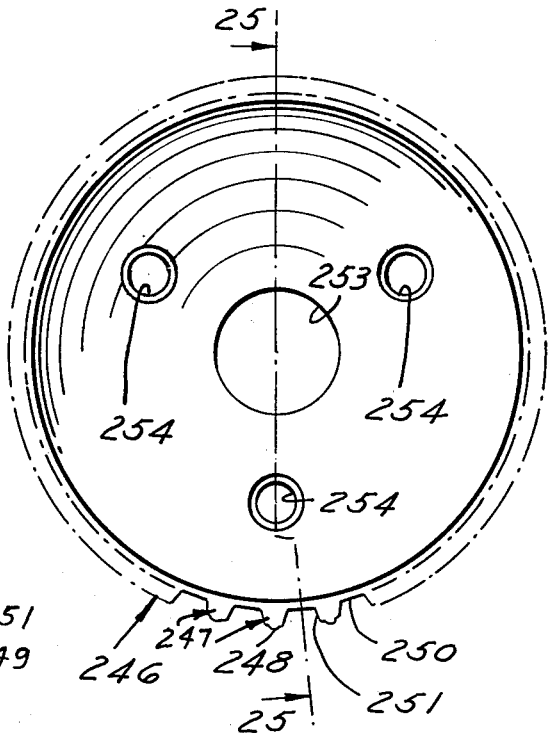
FIG. 24 is a top end view of a forming mandrel for forming a plurality of internal straight spline teeth on a part simultaneously with the forming of external straight spline teeth on the part by a plurality of teeth forming blades as illustrated in FIGS. 21–23.
Figure 26:
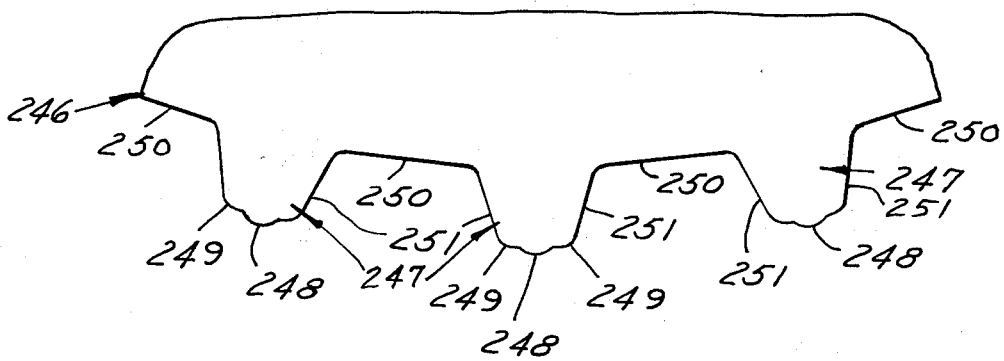
FIG. 26 is a blown-up view of a portion of the periphery of the internal straight spline teeth forming mandrel of FIG. 24, and showing the details of the internal teeth forming mandrel periphery of FIG. 24.

FIGS. 24, 25 and 26 illustrate the details of the tooth forming peripheral edge of the forming head or mandrel, generally indicated by the numeral 246, for co-acting with the forming blades 237 for forming internal straight spline teeth on a workpiece 20. As shown in detail in FIG. 26, the mandrel 246 is provided around its periphery with longitudinally extended tooth forms, generally indicated by the numeral 247. The outer edge of the tooth forms 246 are each provided with a central crown or rounded portion 248 which functions in the same manner as the rounded portions 222 for forming the dimple 30 in the first described workpiece 20. The rounded portions 248 function as protrusions for material driving and form control to insure that the material on the workpiece is driven into the corners of the mating tooth forms on the forming blades 237 during a teeth forming operation. The outer corners of the tooth forms 247 are each provided with a rounded shoulder 249 which terminates in the sloping sides 251 that in turn terminate at the root grooves 250. The forming blades 237 would be pivotally mounted in the same manner as the previously described forming blades 170, and they would operate in the same manner as the previously described forming blades 170. The internal tooth forming mandrel 246 would also function in the same manner as the first described teeth forming mandrel 150. The co-acting forming blades 237 and mandrel 246 would thus function to produce a workpiece 20 with straight spline teeth formed on the inner surface of the cylindrical wall of the workpiece instead of on the external surface. The numeral 253 in FIGS. 24 and 25 represents the axial bore through which would be slidably mounted the stripper shaft 113. Accordingly, it is seen that the bore 253 functions in the same manner as the bore 251 formed through the first described forming mandrel 150. As shown in FIGS. 24 and 25, the mandrel 246 is also provided with a plurality of counterbored holes 254 for receiving attaching screws, as for example, the screws 153 which are mounted through similar counterbored holes 154 in the first described mandrel 150 (FIG. 8).

Figures 27, 28:
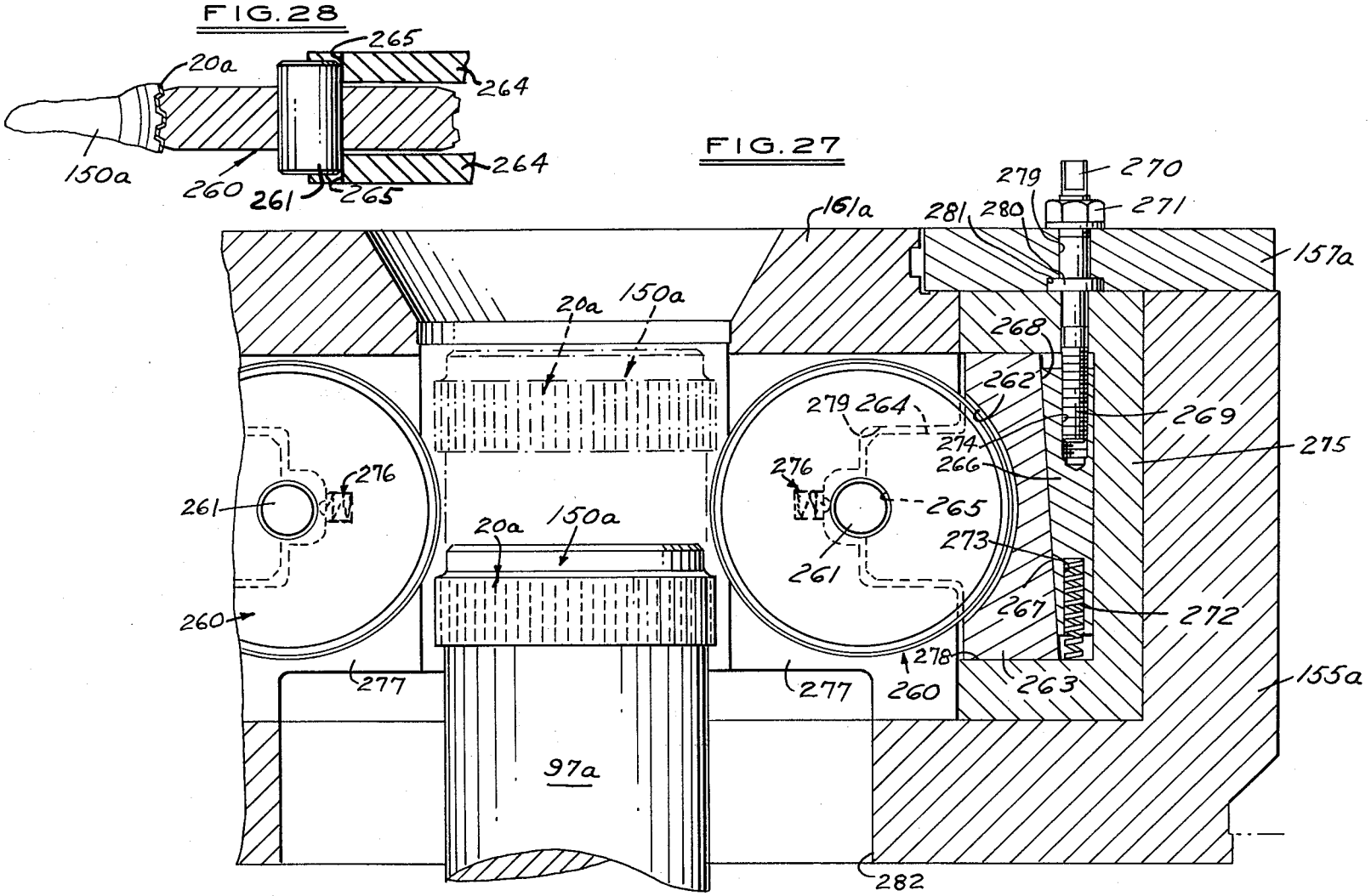
FIG. 27 is a fragmentary, elevation section view of a modified roll-through cold forming apparatus, similar to FIG. 8, and showing a modification of the invention which employs rotary teeth forming blades.
FIG. 28 is a schematic view showing the rotary teeth forming blade of FIG. 27 in an operative engagement with a part during an external straight spline teeth forming operation.

FIG. 27 is a schematic view showing a third embodiment employing rotary teeth forming blades for forming external straight spline teeth on a tubular workpiece. FIG. 28 illustrates the forming of straight spline teeth by use of the rotary teeth forming blades of FIG. 28. The parts of the teeth forming apparatus illustrated in FIG. 27 which are the same as the first embodiment have been marked with the same reference numerals followed by the small letter "a". It will be seen that the embodiment of FIG. 27 would employ a plurality of rotary forming tools, each generally indicated by the numeral 260, which would each be disposed in a radial plane about the travel path of the ram 97*a*. Each of the rotary teeth forming blades 260 would be rotatably mounted on a suitable support shaft 261. Each of the rotary forming blades 260 would be disposed between a pair of laterally spaced apart support arms 264. A rotary shaft arcuate seat 265 is formed on the inner end of each of the support arms 265. The laterally spaced apart support arms 264 are integrally formed with a movable rotary blade carrier block 263 which has a slot 262 formed therein for rotatably receiving the blade 260, and to form a slot between the laterally spaced apart support arms 264. Each of the rotary shaft arcuate seats 265 has one of the ends of the shaft 261 seated therein for rotatably supporting the shaft 261.

Each shaft 261 is biased into engagement with the seats 265 by a spring biased detent means, generally indicated by the numeral 276. Each of the detent means 276 is carried in a separate mounting block 277 which is fixed by any suitable means on either side of the rotary blade 260 and supported by the guide bushing 161*a* and the support housing 155*a*. The block 277 has a stepped recess 279 in its outside for the reception of the support arms 264.

The rotary blade carrier block 263 is slidably mounted in a recess 278 formed in the gib carrier member 275 for inward and outward adjustment movement of the rotary blade 260, for controlling the depth of the teeth forms made in the workpiece 20*a*. An adjustable gib 266 is mounted in the recess 275 behind the carrier block 263. The carrier block 263 is provided with a tapered outer face 268 on which is slidably seated a complementary tapered face 267 on the inner face of the gib 266. The gib 266 may be adjusted upwardly and downwardly in the recess 278 by a screw 270 which is operatively mounted in the retainer housing 157*a* and the gib carrier member 275.

As shown in FIG. 27, the gib adjusting screw 270 is rotatably mounted through a bore 279 formed through the retainer housing 157*a*. A flange 280 is integrally formed on the screw 270, and it is rotatably mounted in an enlarged diameter bore 281 which communicates with the bore 279 in the housing 157*a*. The threaded body 269 of the adjusting screw 270 is threadably engaged in the longitudinally extended threaded bore 274 in the gib 266, for moving the gib 266 upwardly and downwardly, as viewed in FIG. 27. The gib 266 is provided with a normal upward bias, as viewed in FIG. 27, by a spring 272 which is mounted in a bore 273 which extends inwardly in the gib 266, from the lower end thereof. The adjusting screw 270 is adapted to be secured in an adjusted position by a suitable lock nut and washer combination indicated by the numeral 271.

As shown in FIG. 28, each of the rotary teeth forming blades 260 forms two teeth. However, it will be understood that a single tooth rotary tool 260 could be employed. Also, a plurality of tooth forming edges could be employed on a single rotary tool 260, as for example, up to six teeth forming edges could be employed. If it were desired to form thirty teeth on the periphery of a circular workpiece, then fifteen of the two-tooth rotary forming blades or rotary dies 260 would be employed and each would be mounted in the aforedescribed manner.

The workpiece is indicated in FIG. 27 by the numeral 20*a*. The solid line position of the workpiece 20*a* shows the workpiece before the teeth forms are rolled therein. It will be understood that the ram 97*a* and mandrel 150*a* would be moved upward to bring the workpiece 20*a* into interference engagement with a plurality of rotary dies or blades 260, whereby continued upward movement of the mandrel 150*a* to the broken line position shown in FIG. 27 carries out the roll forming operation on the workpiece 20*a* in the same manner as described hereinbefore for the first embodiment, which employed pivotally mounted forming blades 170. The power drive means for the ram 97*a* and mandrel 150*a* would be the same as described hereinbefore for the first embodiment. However, the loading and unloading sequence would vary in the structure shown in FIG. 27. A new workpiece 20*a* would be loaded onto the mandrel 150*a* when it is lowered into the recess 282, below the roll dies 260. Accordingly, in the embodiment of FIG. 27, the unloading would take place after the workpiece 20*a* is moved to the broken line position shown in FIG. 27, and the finished part would be moved upwardly from that position to a position above the guide bushing 161*a* for either manual or automatic unloading of the finished part 20*a*. It will be understood also that any suitable means may be employed for pivotally mounting the rotary blades or dies 260, whereby the loading and unloading operation would then be the same as for the first embodiment.

The pivotally mounted forming blades 170 for the first described embodiment are illustrated as being each provided with two teeth forming edges. However, it will be understood that one or a plurality of teeth forming edges may be employed, as for example, one up to a plurality of six such forming edges.

In some types of machinery, as for example, in automotive transmission, tubular parts are employed which have both internal and external driving spline teeth. The internal and external teeth on such parts may be formed in accordance with the present invention by employing forming blades 170, as illustrated in FIGS. 15, 16 and 17, with a mandrel as illustrated in FIGS. 24, 25 and 26.

While it will be apparent that the preferred embodiments of the invention herein disclosed are well calculated to achieve the results aforestated, it will be appreciated that the invention is susceptible to modification, variation and change.

What is claimed is:

1. In a roll-through cold forming apparatus for forming teeth on a workpiece, the combination comprising:

(a) a housing means;

(b) a tooth forming mandrel for carrying a workpiece;

(c) means for movably mounting said tooth forming mandrel on said housing means for movement along the longitudinal axis of the mandrel;

(d) a plurality of tooth forming blades disposed in a circle about the longitudinal axis of said tooth forming mandrel, in spaced apart radial positions;

(e) each of said tooth forming blades mounted on a supporting pin and having at least one tooth forming edge formed thereon;

(f) means for movably mounting each of said tooth forming blades on said housing means so that the tooth forming edges on all of the tooth forming blades will be engaged by the workpiece when the mandrel is moved past the tooth forming blades and be moved into a rolling, material displacing, tooth forming operation on the workpiece by the moving mandrel; said means for movably mounting each of said tooth forming blades on said housing includes:

(1) a pivot pin operatively mounted on the other end of each of said tooth forming blades; and, (2) a pivot pin seat means on said housing for supporting said pivot shaft for pivoting movement of the blade; said pivot pin seat means comprises:

A. a pivot pin seat block having an arcuate seat formed thereon for receiving said pivot pin for pivotally seating said pivot pin;

B. spring means on said housing for biasing said pivot pin into a pivoting seating engagement on said arcuate pivot seat;

C. adjustment means mounted on said housing for adjusting said pivot pin seat block toward said mandrel against the action of said spring means for adjusting the depth of teeth formed on a workpiece on said mandrel; said adjustment includes:

I. an adjustable gib engagable with the seat block for moving it toward said mandrel; and II. screw means for adjusting an adjustable gib;

(g) means for stripping a finished workpiece from said mandrel after a teeth forming operation on said workpiece, and for loading a new workpiece on the mandrel; and (h) resiliently biased pin means on said housing for each of said tooth forming blades for allowing each blade to be moved to a position to permit the mandrel and a workpiece thereon to move past the blade in one direction to an initial position for a teeth forming operation, and return the blade to an initial workpiece engaging position after said movement of each blade to its initial position.

2. A roll-through cold forming apparatus as defined in claim 1, wherein:

(a) said plurality of forming blades and said forming mandrel are each provided with teeth forming edges for forming external teeth on a workpiece.

3. A roll-through cold forming apparatus as defined in claim 1, wherein:

(a) said plurality of forming blades and said forming mandrel are each provided with teeth forming edges for forming internal teeth on a workpiece.

4. A roll-through cold forming apparatus as defined in claim 1, wherein:

(a) said plurality of forming blades and said forming mandrel are each provided with teeth forming edges for simultaneously forming internal teeth and external teeth on a workpiece.

5. A roll-through cold forming apparatus as defined in claim 1, wherein said means for movably mounting the tooth forming mandrel includes:

(a) an axially disposed shaft attached to said mandrel; and, (b) means for moving said shaft axially to move said mandrel from an initial position into an interference teeth forming engagement with said plurality of forming blades when said mandrel is moved in one direction, and for continuing said movement in said one direction to pivot said blades through a roll-through teeth forming operation on the workpiece, and for moving said mandrel back to said initial position.

6. A roll-through cold forming apparatus as defined in claim 5, wherein said means for moving said shaft axially includes:

(a) a motor means carried by said housing; and, (b) a power drive transmission means interconnecting said motor means and said shaft for moving said shaft axially.

7. A roll-through cold forming apparatus as defined in claim 6, wherein said power drive transmission means includes:

(a) drive nut means connected to said mandrel shaft; and, (b) a worm gear drive means connected to said drive nut means and to said motor means.

8. A roll-through cold forming apparatus as defined in claim 7, wherein said drive nut means includes:

(a) a thread means on the periphery of a portion of the mandrel shaft; and, (b) a threaded drive nut threadably mounted on said thread means.

9. A roll-through cold forming apparatus as defined in claim 5, including:

(a) means for stripping a finished workpiece from said mandrel after a teeth forming operation on said workpiece, and for loading a new workpiece on the mandrel.

10. A roll-through cold forming apparatus as defined in claim 9, wherein said means for stripping a finished workpiece from said mandrel includes:

(a) a stripper head carried by said mandrel;

(b) a shaft attached to said stripper head; and, (c) power means for moving said shaft relative to said mandrel for operating said stripper head.

11. A roll-through cold forming apparatus as defined in claim 10, wherein:

(a) said stripper head shaft is axially and slidably mounted through said mandrel shaft.

12. A roll-through cold forming apparatus as defined in claim 11, wherein said power means includes:

(a) a rack shaft engagable with said mandrel shaft;

(b) a pinion engagable with said rack shaft for moving said rack shaft to move the stripper head shaft in one direction to unload a finished workpiece from the mandrel, and in the other direction to load a new workpiece on the mandrel; and, (c) a motor means carried by said housing and operatively connected to said pinion for driving the pinion.

13. A roll-through cold forming apparatus as defined in claim 1, wherein said means for movably mounting each of said rotary forming blades on said housing includes:

(a) a supporting pin seat means on said housing for mounting said supporting pin for rotary movement of the blade.

14. A roll-through cold forming apparatus as defined in claim 13, wherein said supporting pin seat means comprises:

(a) a supporting pin seat block having an arcuate seat formed thereon for receiving said supporting pin for rotatably seating said supporting pin; and, (b) said biasing means on said housing for biasing said supporting pin into a seating engagement on said arcuate supporting seat.

15. A roll-through cold forming apparatus as defined in claim 14, wherein said means for movably mounting each of said rotary forming blades on said housing includes:

(a) adjustment means mounted on said housing for adjusting said supporting pin seat block toward said mandrel against the action of said biasing means for adjusting the depth of teeth formed on a workpiece on said mandrel.

16. A roll-through cold forming apparatus as defined in claim 15, wherein said adjustment means includes:

(a) an adjustable gib engagable with the seat block for moving it toward said mandrel.

* * * * *